US006634058B1

(12) United States Patent
Lin

(10) Patent No.: US 6,634,058 B1
(45) Date of Patent: Oct. 21, 2003

(54) DOOR CLOSER WITH A RELIABLE ARRESTING EFFECT

(76) Inventor: Percy Lin, 19, Dou-Gong 1st Road, Dou-Liu City, Yun-Lin Hsien (TW)

( * ) Notice: Subject to any disclaimer, the term of this patent is extended or adjusted under 35 U.S.C. 154(b) by 0 days.

(21) Appl. No.: 10/190,539

(22) Filed: Jul. 9, 2002

(51) Int. Cl.[7] ..... E05F 3/00
(52) U.S. Cl. ..... 16/66; 16/49
(58) Field of Search ..... 16/66, 65, 78, 16/72, 67, 49

(56) References Cited

U.S. PATENT DOCUMENTS

| | | | | | |
|---|---|---|---|---|---|
| 836,303 | A | * | 11/1906 | Christensen | 188/67 |
| 3,072,954 | A | * | 1/1963 | Patriquin | 16/66 |
| 3,105,264 | A | * | 10/1963 | Truhon | 16/66 |
| 4,194,264 | A | * | 3/1980 | Stoffregen | 16/52 |
| 4,261,601 | A | * | 4/1981 | Sloan | 285/308 |
| 4,646,398 | A | * | 3/1987 | Myhrman | 482/107 |
| 5,108,066 | A | * | 4/1992 | Lundstrom | 248/410 |
| 5,529,148 | A | * | 6/1996 | O'Leary | 188/67 |
| 5,592,780 | A | * | 1/1997 | Checkovich | 49/386 |
| 5,630,248 | A | * | 5/1997 | Luca | 16/71 |
| 5,832,562 | A | * | 11/1998 | Luca | 16/71 |
| 6,317,922 | B1 | * | 11/2001 | Kondratuk | 16/72 |

* cited by examiner

*Primary Examiner*—Anthony Knight
*Assistant Examiner*—Lisa Bannapradist
(74) *Attorney, Agent, or Firm*—Larson & Taylor PLC

(57) ABSTRACT

A door closer comprises a cylinder and a piston rod mounted in the cylinder and having an exposed section outside the cylinder. A retainer plate, an elastic element, and an end cap are mounted around the exposed section of the piston rod. The retainer plate has a hole through which the exposed section of the piston rod extends. The retainer plate further has a push member extending beyond the end cap through a slot in the end cap. The elastic element is attached between the sleeve and the retainer plate. The push member is pushable toward the sleeve to cause an inner periphery defining the hole of the retainer plate engage with the piston rod such that a side of the retainer plate presses against the pressing rod to stop movement of the piston rod during closing of a door to which the door closer is attached.

3 Claims, 3 Drawing Sheets

DOOR CLOSER WITH A RELIABLE ARRESTING EFFECT

BACKGROUND OF THE INVENTION

1. Field of the Invention

The present invention relates to a door closer with a reliable arresting effect. In particular, the present invention relates to a door closer that may reliably arrest the door in a desired position and prevent injury to the user.

2. Description of the Related Art

FIGS. 1 and 2 of the drawings illustrate a conventional door closer comprising a cylinder 1' having holes 10' in an end thereof. Fasteners 101' extend through the holes 10' to fix the end of the cylinder 1' to a doorframe. A piston rod 2' is mounted in the cylinder 1' and includes an end extending beyond the other end of the cylinder 1'. A retainer plate 3' is mounted around an exposed section 21' of the piston rod 2'. A fastener 211' extends through a hole 210' in the piston rod 2' to fix the end of the piston rod 2' to a door. The length of the exposed section 21' in the open state of the door is longer than that in the closed state of the door. A compression spring 11' mounted in the cylinder 1' is compressed when the door is opened, and the spring force of the compression spring 11' automatically closes the door when the force for opening the door vanishes. In a case that the door is to be retained in a desired open position so that the door would not be closed automatically, the retainer plate 3' includes an arrestor 31' for selectively pressing against a peripheral edge 12' of the other end of the cylinder 1'. Thus, movement of the piston rod 2' is stopped by an inner periphery 301' defining a central hole 30' of the retainer plate 31'. When automatic closing of the door is required again, the retainer plate 3' is moved to disengage the arrestor 31' from the peripheral edge 12' of the cylinder 1'. When the force for opening the door vanishes, the returning force provided by the compression spring 11' closes the door automatically. However, since the retainer plate 3' is slidably mounted around the exposed section 21' of the piston rod 2', the retainer plate 3' is apt to be shifted and thus fails to reliably arrest the door. In addition, the user could be injured by the unshielded retainer plate 3' exposed outside the cylinder 1'.

SUMMARY OF THE INVENTION

An object of the present invention is to provide a door closer with a reliable arresting effect to reliably, precisely arrest the door in a desired open position and prevent injury to the user.

A door closer in accordance with the present invention comprises a cylinder and a piston rod mounted in the cylinder and having an exposed section outside the cylinder. A retainer plate, an elastic element, and an end cap are mounted around the exposed section of the piston rod. The retainer plate has a hole through which the exposed section of the piston rod extends. The retainer plate further has a push member extending beyond the end cap through a slot in the end cap. The elastic element is attached between the sleeve and the retainer plate. The push member is pushable toward the sleeve to cause an inner periphery defining the hole of the retainer plate engage with the piston rod such that a side of the retainer plate presses against the pressing rod to stop movement of the piston rod during closing of a door to which the door closer is attached.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
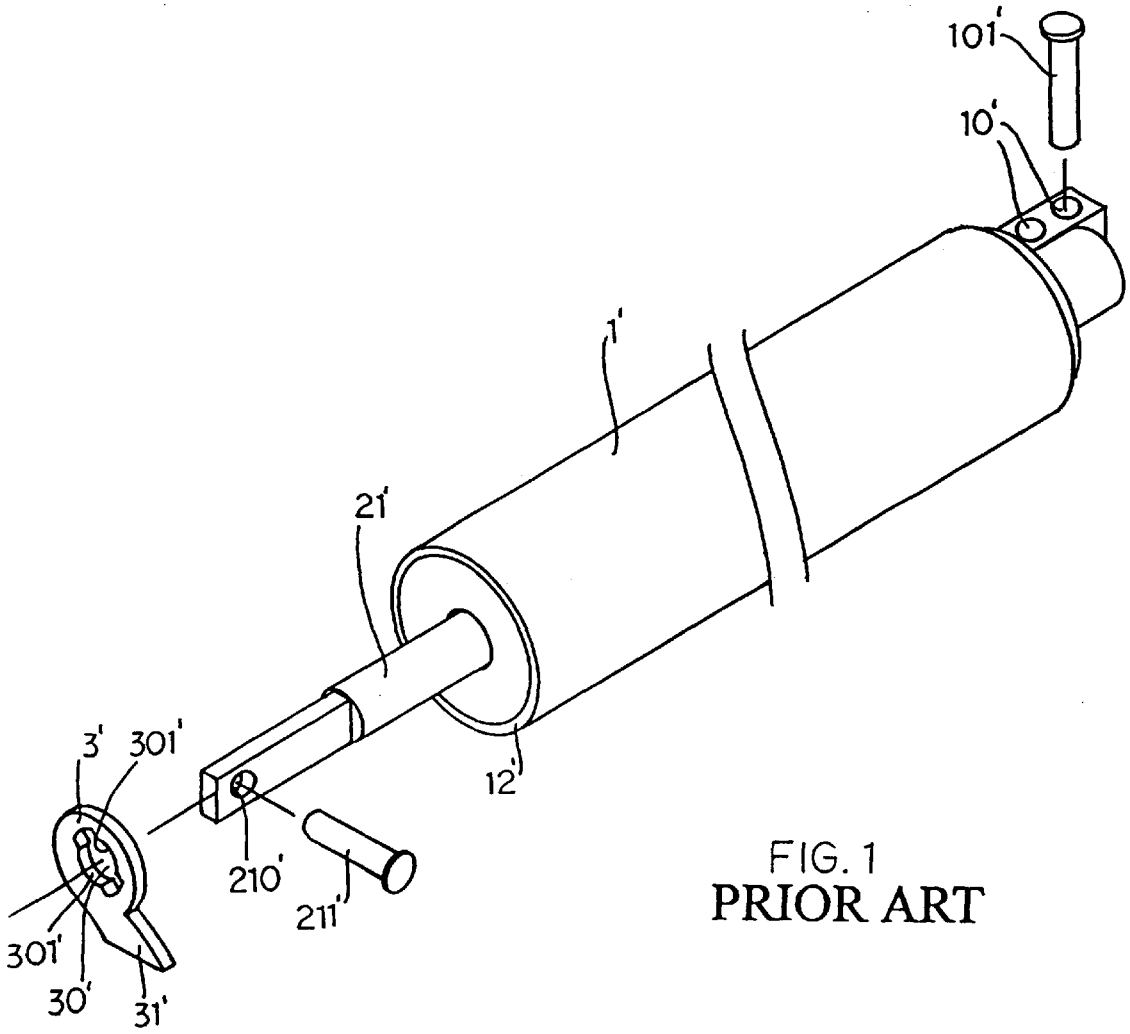
FIG. 1 PRIOR ART
FIG. 1 is a perspective view, partly exploded, of a conventional door closer.
Figure 2:
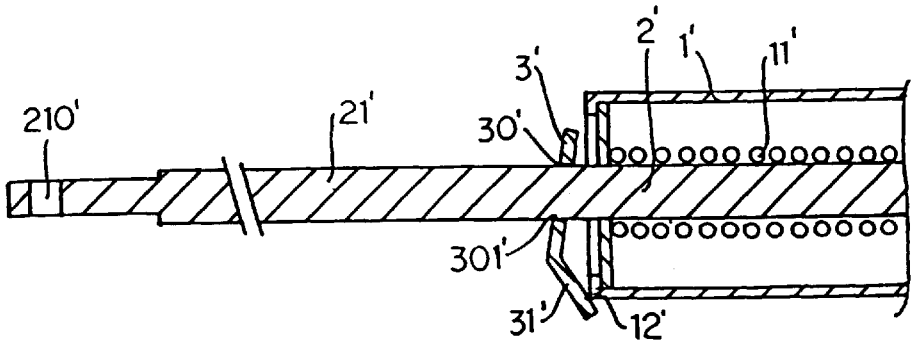
FIG. 2 PRIOR ART
FIG. 2 is a partial sectional view of the conventional door closer.
Figure 3:
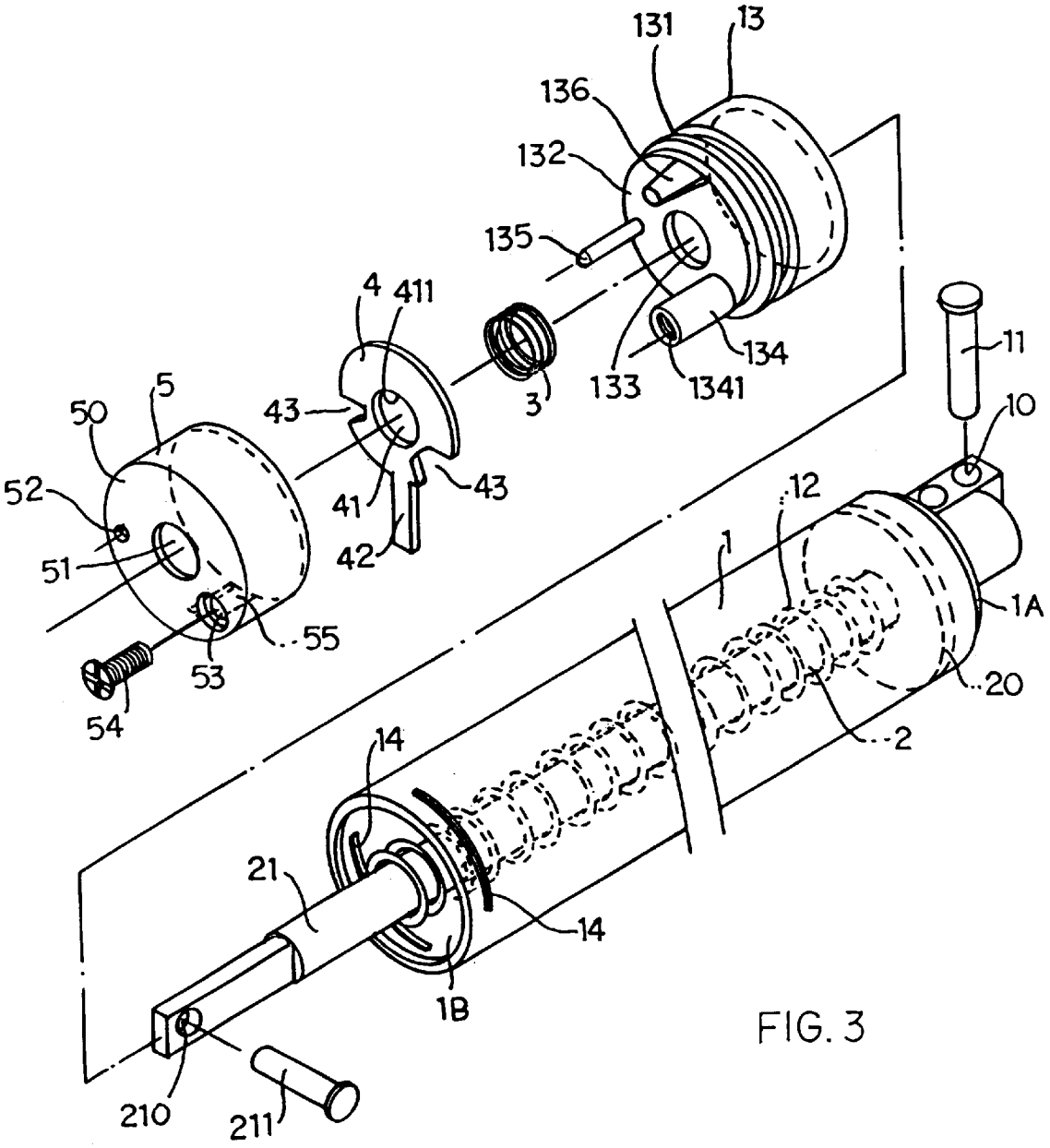
FIG. 3 is a perspective view, partly exploded, of a door closer in accordance with the present invention.
Figure 4:
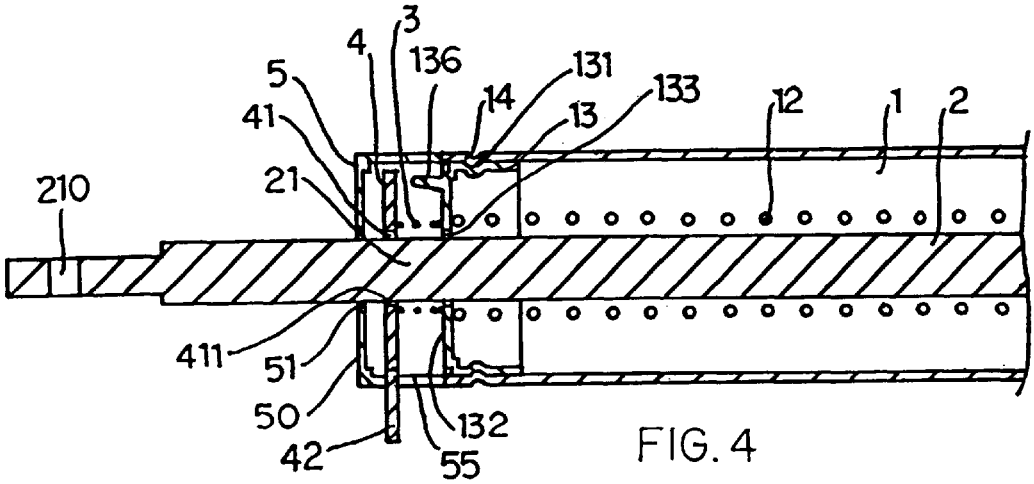
FIG. 4 is a partial sectional view of the door closer in accordance with the present invention.

Referring to FIGS. 3 and 4, a door closer in accordance with the present invention generally comprises a cylinder 1 having a first end 1A and a second end 1B. The first end 1A of the cylinder 1 is closed and includes holes 10 through which fasteners 11 are extended to thereby fix the first end 1A of the cylinder 1 to a doorframe (not shown). The second end 1B of the cylinder 1 is open to allow insertion of a sleeve 13 into the cylinder 1. After insertion of the sleeve 13 into the cylinder 1, the cylinder 1 is punched by a proper tool at a position adjacent to the second end 1B, thereby forming a protruded portion 14 that projects inwardly from an inner periphery of the cylinder 1. The sleeve 13 includes an annular groove 131 in an outer periphery thereof for receiving the protruded portion 14 of the cylinder 1, allowing rotational movement of the sleeve 13 in the cylinder 1. The sleeve 13 further includes an end plate 132 having a central hole 133. Projecting outward from an outer side of the end plate 132 are a peg 134 having a screw hole 1341, a positioning rod 135, and a pressing rod 136.

A piston rod 2 longer than the cylinder 1 is mounted in the cylinder 1. A piston 20 is mounted to an end of the piston rod 2 located in the cylinder 1. The other end of the piston rod 20 extends beyond the open second end 1B of the cylinder 1 and forms an exposed section 21 that has a hole 210. A fastener 211 extends through the hole 210 of the piston rod 2 to fix the other end of the piston rod 2 to a door (not shown). The length of the exposed section 21 in the open state of the door is longer than that in the close state of the door. A compression spring 12 is mounted in the cylinder 1 and around the piston rod 2. An end of the compression spring 12 is attached to a side of the piston 20, and the other end of the compression spring 12 is attached to an inner side of the end plate 132 of the sleeve 13. The compression spring 12 is compressed when the door is opened, and the spring force of the compression spring 12 automatically closes the door when the force for opening the door vanishes.

In a case that the door is to be retained in a desired open position so that the door would not be closed automatically, an elastic element 3, a retainer plate 4, and an end cap 5 are mounted in sequence around the exposed section 21 of the piston rod 2.

The elastic element 3 may be a coil-like compression spring such that the elastic element 3 stores energy when it is compressed, and the stored energy allows the compressed elastic element 3 to restore its original shape. An end of the elastic element 3 is attached an outer side of the end plate 132 of the sleeve 13, and the other end of the elastic element 3 is attached to a side of the retainer plate 4. Thus, when not subject to an external force, the retainer plate 4 is biased by the elastic element 3 and thus does not press against the end plate 132 of the sleeve 13.

The retainer plate 4 includes a central hole 41 through which the exposed section 21 of the piston rod 2 extends. A push member 42 projects downward from a lower side of the retainer plate 4. The retainer plate 4 further includes two notches 43 through which the peg 134 and the positioning rod 135 respectively extend.

The end cap 5 is cylindrical and includes an open end. The other end of the end cap 5 is closed by an end face 50. A slot 55 is defined in a periphery of the end cap 5 in a position adjacent to the open end. The slot 55 has a width the same as that of the push member 42, thereby allowing the push member 42 to extend through the slot 55 to a position beyond the end cap 5. Further, the slot 55 may guide rectilinear movement of the push member 42 along a longitudinal direction of the cylinder 1. A central hole 51 is defined in the end face 50 of the end cap 5, allowing the, exposed section 21 to extend therethrough. A positioning hole 52 is defined in the end face 50 of the end cap 5 and aligns with the positioning rod 135 of the sleeve 13, allowing insertion of the positioning rod 135 into the positioning hole 52. The end face 50 further includes a screw hole 53 aligned with the peg 134 of the sleeve 134. A fastener 54 such as a bolt is extended through the screw hole 53 of the end cap 5 into the screw hole 1341 of the peg 134, thereby enclosing the retainer plate 4 and engaging the end cap 5 with the sleeve 13.

Figure 5:
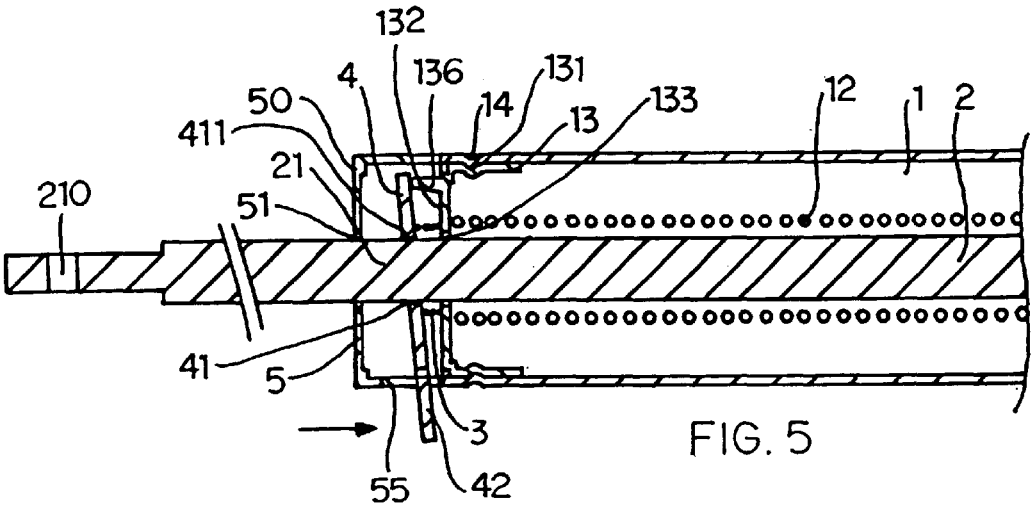
FIG. 5 is a view similar to FIG. 4, illustrating operation for arresting the door in a desired position.

Referring to FIG. 5, when the force for opening the door vanishes, the returning force of the elastic element 12 automatically, gradually closes the door (the piston rod 2 is retracting). When it is desired to retain the door in a desired open position, the user pushes member 42 toward the sleeve 13, causing the retainer plate 4 to incline at an angle and making an inner periphery 411 defining the hole 41 of the retainer plate 4 engage with the piston rod 2. The retainer plate 4 moves along the piston rod 2 for a distance until a side of the retainer plate 4 presses against the pressing rod 136. The piston rod 2 is thus stopped, and the door is kept open at an angle. When automatic closing of the door is required, an external force is applied (the piston rod 2 is outreaching) to open the door such that the retainer plate 4 is disengaged from the peripheral edge 13 of the cylinder 1 under the action of the elastic element 3. When the force opening the door vanishes, the returning force of the elastic element 12 automatically, gradually closes the door.

In accordance with the door closer of the present invention, since the width of the slot 55 of the end cap 5 is the same as that of the push member 42 to allow the push member 42 to extend beyond the end cap 5, allowing push of the push member 42, and since the slot 55 guides rectilinear movement of the push member 42, it is easy to reliably retain the door at a desired angle and thus retain the door open. Further, injury to the user is avoided, as the retainer plate 4 is enclosed by the end cap 5.

Although the invention has been explained in relation to its preferred embodiment, it is to be understood that many other possible modifications and variations can be made without departing from the scope of the invention as hereinafter claimed.

What is claimed is:

1. A door closer comprising:

a cylinder having a closed first end and an open second end;

a sleeve mounted in the open second end of the cylinder, the sleeve including an end plate on an end thereof, the end plate including a central hole, the end plate including a peg and a pressing rod, the peg including a screw hole;

a piston rod mounted in the cylinder, the piston rod extending through the central hole of the end plate of the sleeve, the piston rod having an exposed section outside the cylinder;

an end cap mounted to the open second end of the cylinder and around the exposed section of the piston rod, the end cap including a slot in a periphery thereof, the end cap further including a screw hole, a fastener being extended through the screw hole of the end cap and into the screw hole of the peg of the sleeve, thereby engaging the end cap with the sleeve;

a retainer plate mounted around the exposed section of the piston rod, the retainer plate including a hole, the retainer plate further including a push member projecting therefrom and extending beyond the end cap slot of the end cap; and an elastic element mounted around the exposed section of the piston rod and including a first end attached to a side of the end plate of the sleeve and a second end attached to a side of the retainer plate;

wherein the push member is pushable toward the sleeve to cause an inner periphery defining the hole of the retainer plate engage with the piston rod such that the side of the retainer plate presses against the pressing rod to stop movement of the piston rod during closing of a door to which the door closer is attached.

2. The door closer as claimed in claim 1, wherein the end plate of the sleeve includes a positioning rod, and wherein the end cap includes a positioning hole through which the positioning rod extends.

3. The door closer as claimed in claim 1, wherein the sleeve includes an annular groove, and wherein the open second end of the cylinder includes a protruded portion that is engaged in the annular groove of the sleeve.

* * * * *